United States Patent [19]

LeBlanc

[11] Patent Number: 4,467,699

[45] Date of Patent: Aug. 28, 1984

[54] PNEUMATIC MOTOR

[75] Inventor: Louis H. LeBlanc, Claremont, N.H.

[73] Assignee: Joy Manufacturing Company, Pittsburgh, Pa.

[21] Appl. No.: 318,128

[22] Filed: Nov. 4, 1981

[51] Int. Cl.[3] ..... F01B 7/18; F01L 21/02

[52] U.S. Cl. ..... 91/25; 91/31; 91/231; 91/321; 91/325

[58] Field of Search ..... 91/230, 231, 50, 12, 91/25, 27, 325, 321, 234, 31

[56] References Cited

U.S. PATENT DOCUMENTS

| | | | |
|---|---|---|---|
| Re. 28,859 | 6/1976 | Beaumont | 173/105 |
| 595,791 | 12/1897 | Soley | 91/321 |
| 622,576 | 4/1899 | Waugh | 91/300 |
| 695,396 | 3/1902 | Johnson | 91/321 |
| 705,436 | 7/1902 | Pecoraro | 91/298 |
| 726,074 | 4/1903 | Kotten | 91/232 |
| 727,954 | 5/1903 | Iler | 91/234 |
| 742,934 | 11/1903 | Vaughan et al. | 91/234 |
| 1,096,886 | 5/1914 | Boyles | 91/230 |
| 1,114,075 | 10/1914 | Wakfer | 91/239 |
| 1,128,416 | 2/1915 | Crump | 91/234 |
| 1,414,224 | 4/1922 | Smith | 91/231 |
| 1,660,201 | 2/1928 | Lee | 91/234 |
| 1,726,352 | 8/1929 | Hulsmizer | 91/234 |
| 1,800,344 | 4/1931 | Gustafson | 91/302 |
| 2,722,918 | 11/1955 | Kimball | 91/234 |
| 3,329,068 | 7/1967 | Klaus | 91/402 |
| 4,194,435 | 3/1980 | Gaun et al. | 91/25 |

*Primary Examiner*—Paul E. Maslousky

*Attorney, Agent, or Firm*—Buell, Blenko, Ziesenheim & Beck

[57] ABSTRACT

A valveless, pneumatic motor including a cylinder within which a hammer piston reciprocates and a buffer ring fixedly secured within the cylinder. A source of motive fluid under pressure cooperates with the buffer ring which through supply porting provides pressurized motive fluid alternately to opposed faces of the piston head. Intake ports are formed within the piston stem and adapted to cooperate intermittently with the buffer ring supply porting to provide motive fluid to the piston interior wherein an axial bore transmits the fluid along the stem toward the piston head and discharge porting delivers the motive fluid to the forward face of the piston head thereby urging the piston rearwardly. A reduced diameter portion of the piston stem then comes into communication with the buffer ring supply porting and permits the motive fluid to impinge directly on the rearward face of the piston head without passage through the piston to urge the piston forwardly. Specific porting arrangements and mechanical relationships are disclosed.

8 Claims, 1 Drawing Figure

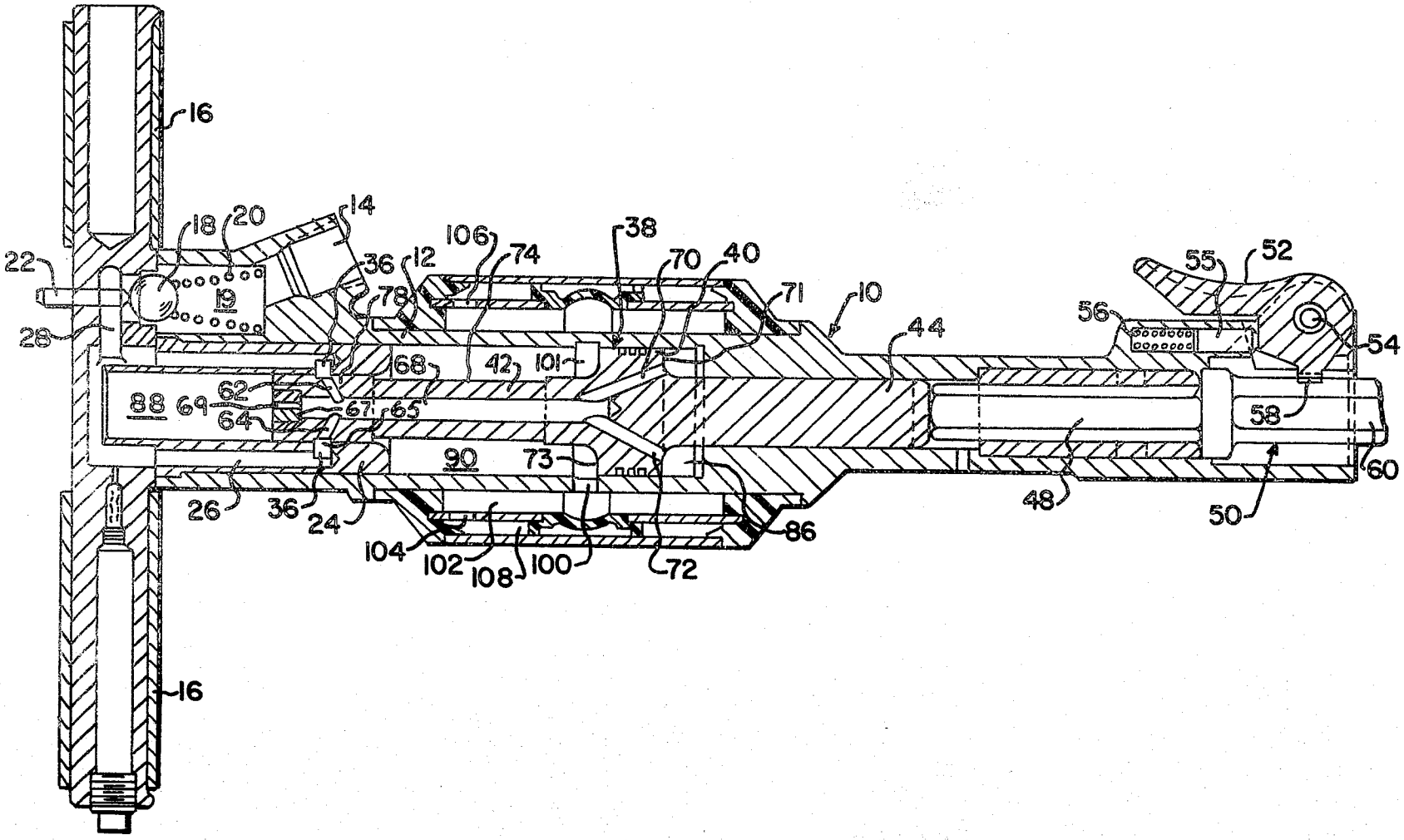
54
60
52
58
50
55
56
48
44
10
71
86
40
70
72
38
101
73
100
74
42
108
106
90
102
12
68
104
78
36
65
67
14
24
36
20
62
18
12
64
26
16
88
69
16
22
28

PNEUMATIC MOTOR

BACKGROUND OF THE INVENTION

1. Field of the Invention

This invention relates to pneumatic motors for rock drills and the like and, more specifically, relates to such motors which are valveless and have improved means for distributing motive fluid so as to cause the desired reciprocating movement of a hammer piston within the cylinder.

2. Description of the Prior Art

It has been known to provide pneumatically actuated apparatus wherein a piston is caused to reciprocate within a cylinder under the influence of pressurized air thereby causing the piston to deliver a series of impact blows to a tool such as a striking bar, a tappet or drill rod. In such systems, initial propulsion of the piston results from the influence of the pressurized motive fluid with the subsequent travel being due to inertia of the piston coupled with residual pressure of the motive fluid. When the piston has reached the limit of its travel in a first direction, motive fluid is delivered to the opposite side of the piston causing it to reciprocate in the reverse direction initially under the influence of the pressurized motive fluid and subsequently under the influence of inertia coupled with residual pressure from the motive fluid.

Various internal means for alternately conducting the pneumatic fluid to opposite sides of the piston head have been known. It has been known to employ various passageway constructions in combination with separate valve members. See, for example, U.S. Pat. Nos. 622,576; 705,436; 727,954 and 1,800,344. It has also been known to provide systems wherein the cylinder profile cooperates with passageways in such a fashion as to establish a valving action. See, for example, U.S. Pat. Nos. 726,074; 742,934; 1,114,075; 1,128,416; 1,660,201; 1,726,352; 2,722,918; 3,329,068 and U.S. Pat. No. Re. 28,859.

One of the problems encountered with prior art constructions has been the inherent complexity and the need to engage in extensive machining operations in order to provide the desired passageways for transport of the motive fluid. Such designs not only contribute to complexity of manufacture and repair, but also increase the product cost.

There remains a very real and substantial need for improved pneumatic motors which are of relatively simple design and yet provide efficient operation over a prolonged period of use.

SUMMARY OF THE PRESENT INVENTION

The above-described need has been met by the present invention. In a preferred embodiment of the invention, a valveless cycle is employed with a hammer piston being received within a cylinder and a buffer ring being fixedly secured within a rear portion of the cylinder. The buffer ring is in communication with a source of motive fluid under pressure and has supply ports for delivering motive fluid to the hammer piston. The hammer piston has intake ports in communication with the outer peripheral surface of the stem of the hammer piston for receipt of motive fluid from the buffer ring supply ports. The hammer piston has an axial bore in communication with the intake ports. The bore cooperates with the discharge ports disposed within a forward portion of the piston. In this fashion motive fluid, when the supply ports and intake ports are aligned, will be delivered to the downstream face of the piston thereby urging the piston rearwardly. The piston also has a reduced diameter portion interposed between the intake ports and the piston head such that when the reduced diameter portion is in communication with the buffer ring supply ports, pressurized motive fluid will be supplied directly to the upper surface of the piston head in order to urge the piston forwardly.

In a preferred embodiment the reduced diameter portion of the piston stem will have a greater axial extent than the remainder of the piston stem and also greater than the axial extent of the intake port means measured along the periphery of the hammer piston stem.

It is an object of the present invention to provide a pneumatic motor which is valveless and has effective means for delivering motive fluid to the opposite faces of the piston head so as to reciprocate the piston.

It is a further object of the present invention to provide such a pnueumatic motor wherein a buffer ring is adapted to communicate with the hammer piston so as to deliver motive fluid under pressure to the piston head to effect reciprocation of the piston within the cylinder.

It is a further object of the present invention to provide a pneumatic motor so designed as to provide full air pressure on the entire piston downstroke surface area in order to enhance the efficiency of operation.

It is a further object of the invention to provide such a motor which is of relatively simple design and does not require extensive networks of passageways or extensive machining to manufacture the same.

These and other objects of the invention will be more fully understood from the following description of the invention on reference to the illustration appended hereto.

BRIEF DESCRIPTION OF THE DRAWING

The drawing illustrates, in partially schematic form, a cross-sectional illustration of a form of pneumatic motor of the present invention showing the hammer piston in its forwardmost position.

DESCRIPTION OF THE PREFERRED EMBODIMENTS

As is shown in the Figure, the pneumatic motor of the present invention, in the form illustrated, has a housing 10 which includes a cylinder 12. An air intake 14 is defined within the housing and is adapted to be connected to a suitable source of motive fluid such as air under pressure. The handle portion has a pair of grip members 16. A check valve element 18 which is biased by helical spring 20 so as to close the passageway 19 connecting the air intake 14 with the interior of the pneumatic motor is provided. Pin 22 which is in contact with the valve element 18 and projects out of the handle 16 is adapted to be manually engaged and when depressed displace the valve element 18 thereby permitting introduction of motive fluid into the interior of the pneumatic motor through passage 28 to buffer ring 24.

The buffer ring 24 has a generally cylindrical exterior configuration and is fixedly secured within the cylinder 12 at a rear portion thereof. The buffer ring 24 has an annular chamber 26 which by passageway 28 communicates with air intake 14 through passageway 19 when the valve element 18 is displaced from its seat. In this fashion, displacement of the valve element 18 will result in introduction of air or other pneumatic fluid into the interior of buffer ring 24. Buffer ring 24 has a series of supply port openings 36 connecting annular chamber 26 with the interior of the cylinder 12. In a fashion which will be described below, pneumatic fluid introduced through supply port openings 36 serves to move the piston in a reciprocating path.

Considering now the construction of the hammer piston 38 in greater detail, it will be noted that the piston 38 has a piston head 40, a generally rearwardly projecting piston stem 42 and a generally forwardly projecting hammer portion 44. The stem 42 and hammer portion 44 are of reduced diameter with respect to the diameter of the piston head 40.

In operation, the hammer piston 38 is adapted to reciprocate and provide repeated impact blows to the drill rod 50 at the free end adjacent rear portion 48. A drill rod retainer 52 is rotatable about pivot 54 and has a tongue portion 58 adapted to be received within a recess in the housing and groove 60 of a drill rod 50 thereby permitting relative sliding movement of the drill rod 50 while being retained in the housing 10. Spring biased member 55 acting under the influence of helical spring 56 serves to retain the latching member 52 in the desired position during operation.

Referring once again to the piston 38, it will be noted that in the form shown, the piston has a number of generally radially oriented intake ports 62, 64 which are in communication with an annular recess 65 formed within the outer periphery of the piston stem 42 and with an axial bore 68 in the piston 38. In the piston position illustrated, the intake port means 62, 64 are in communication with the supply port means 36 of the buffer ring 24 through an annular recess formed within the piston stem 42 at the surface, thereof. Air or other pneumatic fluid introduced into the buffer ring annular chamber 26 will, with the piston in the illustrated position, pass through supply port means 36 into intake port means and then forwardly through the axial bore 68. Discharge port means 70, 72 are in communication with the axial bore 68 and forward chamber 86. As pressure builds within chamber 86, the pressure will be applied to the downstream of forward surface 71 of piston head 40 thereby urging the piston rearwardly. As rearward motion of the piston 38 is initiated, communication between supply port means 36 and intake port means (the annular recess 65, and port means 62, 64) will be terminated thereby cutting off the supply of pressurized motive fluid to chamber 86. Motion of the piston in a rearward direction will continue under the influence of the remaining pressurized fluid in chamber 86 coupled with the inertia of the piston 38.

The diameter of the piston stem portions axially adjacent to intake port means 62, 64 will be less than the internal diameter of adjacent portions of the buffer ring 24 with the diameters preferably being sufficiently close as to resist undesired passage of motive fluid therebetween. This sector of the piston stem has been generally identified by the reference number 78.

Disposed intermediate stem sector 78 and the piston head 40 is a reduced diameter sector 74 of stem 42. The axial extent of this reduce diameter portion 74, in one preferred embodiment is preferably greater than the remainder of piston stem 42. The axial extent of reduced diameter portion 74 should be enough to allow proper sequential valving and "dead" cushion ending of the stroke by piston stem 42. As the piston 38 moves rearwardly and communication between supply port means 36 and intake port means is cut off by sector 78, continued rearward movement of the piston 38 results in the reduced diameter sector 74 coming into communication with supply port means 36. Thus, the rearward movement of the piston 38 is terminated through a combination of residual motive fluid present in chamber 88, the cutoff of supply of motive fluid to chamber 86 and lost inertia of the piston. Pressurized motive fluid is supplied by supply ports 36 to chamber 90 through passage between the interior of the buffer ring 24 and the reduced diameter portion 74 of piston stem 42. As pressure builds up within chamber 90 it will be applied to rear piston head surface 73 and urge the piston forwardly. After forward travel has resulted in termination of communication between supply port means 36 and the piston surface 73 through reduced diameter portion 74, the piston will continue moving forwardly under the influence of residual pressurized air within chamber 90 and inertia. This will cause the forward end of hammer portion 44 to impact with drill rod 50. It will be appreciated, that in the form shown, the piston head 40, the piston stem 42, and the hammer portion 44 are integrally formed as a unit.

In the form illustrated, the axial bore 68 terminates forwardly of the free end of the piston stem 42. The intake port means 62, 64 are generally radially oriented and are slightly angularly forwardly directed. The discharge port means 70, 72 diverge from the axial bore 68 to the downstream piston surface 71.

Considering now the cylinder exhaust system and the means by which it operates, it will be noted that an exhaust passageway 100 communicates with the interior of the cylinder at annular enlargement 101 and with annularly continuous external chamber 102. Exhaust gases entering chamber 102 will be delivered to second annular substantially continuous chamber 108 through passageways 104, 106 and from this chamber be discharged through an opening (not shown) to the atmosphere. This construction facilitates muffling of sound from the exhaust gases. Disposed within the free end of the stem 42 is an insert plug 67 which has a reduced diameter bore 69 connecting bore 68 with chamber 88 to assist with initiation of piston movement to start the cycle by flow of motive fluid from bore 68 to chamber 88. As the piston head 40 moves rearwardly from the position shown in the figure it will serve to cut off communication between chamber 90 and exhaust port 100. As rearward travel of piston 38 is initiated from the piston's forwardmost position, air will be exhausted from chamber 90 through exhaust passageway 100. Continued travel of the piston 38 rearwardly will result in the forward surface 71 becoming aligned with the exhaust passageway 100 thereby permitting communication between chamber 86 and exhaust port 100. At this point in rearward travel, the movement of the piston 38 in a rearward direction will become primarily due to the influence of inertia as motive fluid from chamber 86 will be discharged through exhaust passage 100.

With the piston in the rearwardmost postion, as forward movement is initiated, the piston head 40 will be disposed rearwardly of exhaust passage 100 thereby permitting forward movement of piston head 40 to provide for exhaust of motive fluid from chamber 86 through passageway 100. When piston head face 71 goes beyond exhaust passage 100, communication between chamber 86 and exhaust passage 100 will be cut off. During continued travel in a forwardly direction of the piston head 40 communication between both chambers 86 and 90 with exhaust passageway 100 will be cut off until rearwardly facing surface 73 of piston head 40 becomes aligned with passageway 100 at which point exhaust of gases from chamber 90 through passageway 100 is permitted. At this point the primary impetus for forward movement of the piston 38 will be inertia as the pressurized motive fluid in chamber 90 is being discharged through exhaust passageway 100.

It will be appreciated, therefore, that the present invention provides a valveless pneumatic motor wherein a buffer ring fixedly secured within the cylinder serves to deliver motive fluid under pressure alternately through the piston to the downstream surface of the piston head and directly to the upstream surface of the piston head, thereby providing an efficient and economical-to-use and produce construction.

Whereas particular embodiments of the invention have been described above for purposes of illustration, it will be evident to those skilled in the art that numerous variations of the details may be made without departing from the invention as defined in the appended claims.

I claim:

1. A pneumatic motor comprising a hammer piston having a piston head and a rearwardly projecting piston stem, a cylinder within which said hammer piston is positioned for relative reciprocating movement, a buffer ring fixedly secured within a rear portion of said cylinder receiving a portion of said hammer piston stem, inlet port means in communication with said buffer ring for supplying pressurized motive fluid thereto, supply port means formed within said buffer ring for delivering said motive fluid to said hammer piston, intake hammer piston port means in communication with the outer peripheral surface of said hammer piston stem for intermittent communication with said supply port means, said hammer piston having an axial bore in communication with said intake hammer piston port means, discharge hammer piston port means in communication with the forward surface of said piston head and said hammer piston axial bore, a reduced diameter portion of said hammer piston stem disposed between said intake hammer piston port means and said piston head having a diameter less than the internal diameter of said buffer ring, said buffer ring supply port means when in communication with said intake hammer piston port means adapted to supply motive fluid to the forward surface of said piston head to urge said piston rearwardly and when in communication with said reduced diameter portion of said stem adapted to provide motive fluid to the rearward surface of said piston head by flow externally of said piston to urge said piston forwardly, said hammer piston having a reduced diameter hammer portion projecting forwardly from said piston head, said discharge hammer piston port means having a number of passageways diverging from said axial bore to said piston head forward face, said intake hammer piston port means having a number of passageways oriented generally radially between the periphery of said piston stem and said axial bore, said piston stem having a generally rearwardly disposed free end, and said axial bore terminating short of the free end of said hammer piston stem, and reduced diameter bore means connecting said axial bore with the free end of said piston stem.

2. The pneumatic motor of claim 1 including the axial extent of said reduced diameter stem portion being greater than the axial extent of the remainder of said piston stem.

3. The pneumatic motor of claim 1 including said intake hammer piston port means having an annular recess.

4. The pneumatic motor claim 3 including said cylinder having exhaust port means in communication with a portion of said cylinder through which said piston head travels.

5. The pneumatic motor of claim 4 including the external circumference of said piston stem disposed between said intake hammer piston port means and said reduced diameter stem portion cooperating with said supply port means to initiate and terminate communication between said supply port means and said intake hammer piston port means, and the external portion of said hammer piston stem disposed between said intake hammer piston port means and said reduced diameter portion serving to initiate and terminate communication between said supply port means and the said reduced diameter portion.

6. The pneumatic motor of claim 1 including said buffer ring supply port means having a generally continuous annular passageway.

7. The pneumatic motor of claim 1 including the diameter of said piston stem portion adjacent to said intake hammer piston port means being generally equal to but slightly smaller than the internal diameter of said buffer ring adjacent said supply port means but greater than the diameter of said reduced diameter portion, whereby said stem portion will be slidingly received within said buffer ring with undesired leakage of said motive fluid between said buffer ring and said stem being resisted while desired flow of motive fluid between said buffer ring and said reduced diameter portion is permitted.

8. The pneumatic motor of claim 1 including said hammer portion being integrally formed with said hammer piston.

* * * * *